US006363682B1

(12) United States Patent
Cowley

(10) Patent No.: US 6,363,682 B1
(45) Date of Patent: Apr. 2, 2002

(54) LUMBER STRUCTURAL ENHANCER

(76) Inventor: Eric W. Cowley, 4 David Lapsley Rd., Bedford, NY (US) 10506

( * ) Notice: Subject to any disclaimer, the term of this patent is extended or adjusted under 35 U.S.C. 154(b) by 0 days.

(21) Appl. No.: 09/337,798

(22) Filed: Jun. 22, 1999

(51) Int. Cl.[7] ..... E04B 3/30

(52) U.S. Cl. ..... 52/730.7; 52/737.3; 52/729.5; 52/724.1; 52/737.6

(58) Field of Search ..... 52/724.1, 730.1, 52/731.1, 731.5, 731.7, 729.1, 729.2, 729.14, 712, 731.9, 737.3, 737.6, 730.7, 730.4, 731.2, 732.1, 729.4, 729.5

(56) References Cited

U.S. PATENT DOCUMENTS

| | | | | | |
|---|---|---|---|---|---|
| 1,351,615 | A | * | 8/1920 | Brown | 52/731.2 |
| 1,658,407 | A | | 2/1928 | Gustaveson | |
| 2,108,373 | A | * | 2/1938 | Greulich | 52/729.5 |
| 2,134,674 | A | | 10/1938 | Sherman et al. | |
| 2,178,388 | A | | 10/1939 | Beckman | |
| 2,683,927 | A | | 7/1954 | Maroneck | |
| 2,851,747 | A | * | 9/1958 | Rolen | 52/731.2 |
| 3,517,474 | A | * | 6/1970 | Lanternier | 52/731.7 |
| 3,899,152 | A | * | 8/1975 | Avery | 249/18 |
| 4,070,845 | A | * | 1/1978 | Cody | 52/729.4 |
| 4,455,806 | A | * | 6/1984 | Rice | 52/732 |
| 4,466,225 | A | | 8/1984 | Hovind | |
| 4,576,849 | A | * | 3/1986 | Gardiner | 52/729.4 |
| 4,862,667 | A | | 9/1989 | Melland | |
| 4,866,798 | A | | 9/1989 | Harris | |
| 5,377,472 | A | | 1/1995 | Terenzoni | |
| 5,452,556 | A | | 9/1995 | Taylor | |
| 5,535,569 | A | * | 7/1996 | Seccombe | 52/731.7 |
| 5,625,997 | A | | 5/1997 | Callahan et al. | |
| 5,678,381 | A | | 10/1997 | DenAdel | |
| 5,713,176 | A | | 2/1998 | Hunt | |
| 5,809,735 | A | | 9/1998 | Leblanc | |
| 6,115,986 | A | * | 9/2000 | Kelly | 52/731.7 |

FOREIGN PATENT DOCUMENTS

| | | |
|---|---|---|
| GB | 1257484 | 4/1919 |
| GB | 128182 | 7/1919 |

OTHER PUBLICATIONS

Excerpts from Product Application Guide, Unistrut Corporation.

Excerpts from Stud–Rite Lightweight Steel Framing, Marino Industries Corp.

* cited by examiner

*Primary Examiner*—Beth A. Stephan
(74) *Attorney, Agent, or Firm*—Amster Rothstein & Ebenstein

(57) ABSTRACT

A lumber structural enhancer of unitary, one-piece and integral construction is adapted for use with an axially extending beam of wood, the beam being of substantially rectangular cross-section and having a pair of opposing sides and at least one bight connecting the opposing sides. The enhancer includes an axially extending, thin, substantially planar web of structural metal, and a pair of axially extending folded tubes of structural metal, the tubes being of substantially rectangular cross-section and connected by the web. The web is configured and dimensioned to overlap and abut the beam bight, and each of the tubes is configured and dimensioned to overlap and abut a respective one of the opposing beam sides. The enhancer and the beam of wood are joined together in use, e.g., by nailing, to form a composite combining a high moment of inertia and a low weight per linear foot.

12 Claims, 3 Drawing Sheets

10
14
14A
14B
14C
14D
28
22
12
26
20
20A
24
2

LUMBER STRUCTURAL ENHANCER

BACKGROUND OF THE INVENTION

The present invention relates to a structural enhancer for beams of lumber, and more particularly to such an enhancer which provides a high moment of inertia of the beam/enhancer composite with only a modest increase in weight over the beam itself.

In instances where a beam of wood will be subject to severe torsional forces (that is, transverse or other non-axially directed forces), it is known to reenforce the beam by securing to it an axially extending flitch plate formed of structural metal. The flitch plate may be in configuration a planar plate, a right-angle brace (where only torsion of a given moment is expected), or a C- or U-shaped member wherein the web or bight extends along one side of the beam, with each of the legs being bent generally transverse to the web to extend along a respective one of the opposing sides of the beam. The conventional planar flitch plate has a different thickness than the beam, but preferably shares the axial and transverse dimensions thereof.

The conventional planar flitch plate—and indeed to some degree the right-angle, and U or C flitch plates—is not entirely satisfactory for its intended use. This is because in the composite the increase in the moment of inertia produced by the flitch plate (relative to the moment of inertia of the beam alone) is purchased at the expense of a substantial increase in weight of the composite (relative to the weight of the beam alone), even when the transverse dimension of the U or C plate is less than that of the beam.

Additionally, the flitch plate is typically custom fabricated, therefore requiring shop drawings and the fabrication time required by a steel shop to make the flitch plate. Assembly of the composite (that is, the flitch plate and the beam) is commonly performed using a torch and bolts, a time-consuming process not well suited to field installation.

Accordingly, it is an object of the present invention to provide an enhancer which replaces a conventional flitch plate, whether planar, right-angled, or C or U shaped.

Another object is to provide such an enhancer composite having about the same moment of inertia (or even higher) as a comparable conventional flitch plate composite.

A further object is to provide such enhancer composite being about as light (or even lighter) than a comparable conventional flitch plate component.

It is an object of the present invention to provide such enhancers which would be available at lumberyards in various sizes to fit standard dimensional lumber, with the wall thickness of the enhancer web being available in standard gauges.

It is another object to provide a composite of the enhancer and a beam of wood.

SUMMARY OF THE INVENTION

It has now been found that the above and related objects of the present invention are obtained in a lumber structural enhancer of unitary, one-piece and integral construction adapted for use with an axially extending beam of wood, the beam being of substantially rectangular cross-section and having a pair of opposing sides and at least one bight connecting the opposing sides. The enhancer comprises an axially extending, thin, substantially planar web of structural metal, and a pair of axially extending folded tubes of structural metal, the tubes being of substantially rectangular cross-section and connected by the web. The web is configured and dimensioned to overlap and abut the beam bight, and each of the tubes is configured and dimensioned to overlap and abut a respective one of the pair of opposing beam sides.

The tubes may be transversely aligned and extend to the same side of the web or not transversely aligned and extend to respective opposite sides of the web. The tubes are preferably four linear segment tubes folded from a single piece of structural metal, the first and last segments at least closely approaching each other in substantially transverse relationship. The tubes are optimally five linear segment tubes folded from a single piece of structural metal, the first and last segments overlapping and at least partially abutting each other in substantially parallel relationship.

The present invention additionally encompasses in combination at least one such axially extending beam of wood, and an enhancer secured thereto.

BRIEF DESCRIPTION OF THE DRAWING

The above and related objects, features and advantages of the present invention will be more fully understood by reference to the following detailed description of the presently preferred, albeit illustrative, embodiments of the present invention, when taken in conjunction with the accompanying drawing wherein.

DETAILED DESCRIPTION OF THE PREFERRED EMBODIMENTS

Figures 1, 2:
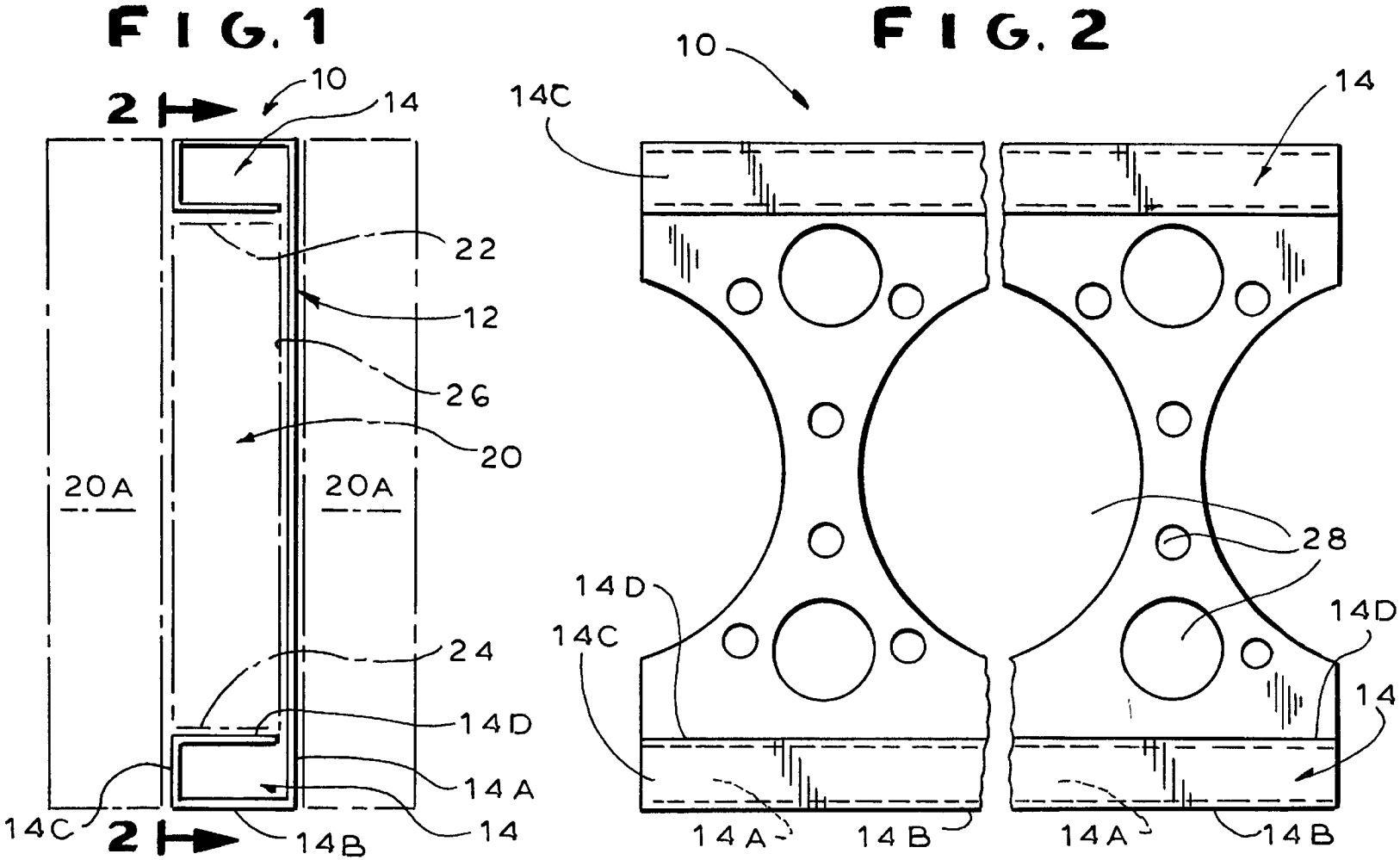
FIG. 1 is an end elevational view of a first embodiment of an enhancer according to the present invention and three axially extending wooden beams.
FIG. 2 is a fragmentary side elevational view of the enhancer taken along the line 2—2 of FIG. 1.

Referring now to drawing and in particular to FIGS. 1–2 thereof, therein illustrated is a first embodiment of an enhancer according to the present invention, generally designated by the reference numeral 10. The enhancer 10 is essentially rigid and comprises an axially extending, thin, substantially planar weld of structural metal, generally designated 12, and a pair of axially extending folded tubes of structural metal, generally designated 14, of substantially rectangular cross-section. Each tube 14 is disposed at an opposed end of the web 12, and the pair of tubes 14 is connected by the web 12.

The tubes 14 of the first embodiment 10 are each formed of four linear segments, 14A, 14B, 14C, 14D with the first and last segments (that is, the first and fourth segments 14A, 14D) approaching each other transversely and almost abutting. Preferably, for ease of fabrication, a slight gap of 1 mm or so is left between adjacent portions of the first and last segments 14A, 14D. The tubes 14 add greatly to the moment of inertia of the beam because a greater weight of the structural metal is positioned away from the neutral axis of inertia of the beam than in the case of a conventional flitch plate (whether planar, right-angle, or C or U shaped).

The enhancer 10 is adapted for use with an axially extending beam of wood, generally designated 20. As illustrated in phantom line in FIG. 1, the beam 20 is of substantially rectangular cross-section, although the edges thereof may be slightly smoothed or rounded. The beam 20 has a pair of U 339 o,opposing sides 22, 24 and at least one bight 26, the bight 26 being a side connecting the opposing sides 22, 24. The web 12 overlaps and abuts the beam bight 26, and each of the tubes 14 overlaps and abuts a respective one of the opposing beam sides 22, 24.

The enhancer 10 is of unitary, one-piece and integral construction, typically formed by cold rolling the end portions of a plate of galvanized steel or other suitable structural material into tubes 14, although a variety of other processes may be used in order to obtain the desired configuration of the enhancer. The structural metal of which the enhancer 10 is constructed is preferably a cold rolled material, bent out of a sheet of galvanized 50 ksi sheet steel into a C- or J-shaped configuration, with opposed ends (e.g., the top and bottom ends) of the web 12 forming rectangular tubes 14.

The enhancer may be made available in various sizes to fit standard dimensional lumber, the wall thickness of the enhancer web being available in standard gauges. The enhancer can be made available at lumber yards, to be purchased with a wooden beam, thereby to eliminate the required shop drawing and fabrication time required to make a flitch plate. The enhancer may be provided with "punch out" areas 28, preferably in web 26, which may be easily removed for nailing and/or conduit penetrations.

The enhancer can be field cut using standard field cutting tools, such as a Sawzall, in a relatively simple and rapid procedure. In formation of a composite from an enhancer 10 and a beam 20 secured together, the carpenter in the field simply cuts the enhancer to an appropriate axial length using standard field cutting tools, positions the beam 20 within the enhancer 10, and uses stud nails to fasten the two together to form the composite. Optionally, additional beams 20 A may be added to either side or both sides of the composite, again by nailing (not shown), to form a double or triple beam suitable for carrying the required load. Multiple side-by-side enhancers may be used in connection with multiple beams in order to achieve the required strength. Multiple axially aligned enhancers may also be used.

Where the enhancer/beam assembly 10/20 (consisting of the enhancer 10 and a beam 20 disposed between the enhancer tubes 14 ) is to be of the same width as the other beams being used (for example, the additional beams 20A), the main beam 20 will be of a reduced width relative to the additional beams 20A so as to accommodate the tubes 14 on either side. Preferably the tubes 14 in combination have a thickness which enables both the main beam 20 and the additional beams 20A to be easily available standard dimensional lumber.

It will be appreciated by those skilled in the art that the closed tubes 14 at the opposed ends (e.g., the top and bottom) of the enhancer web 12 increase the composite's moment of inertia relative to a comparable flitch plate composite.

Figure 4:
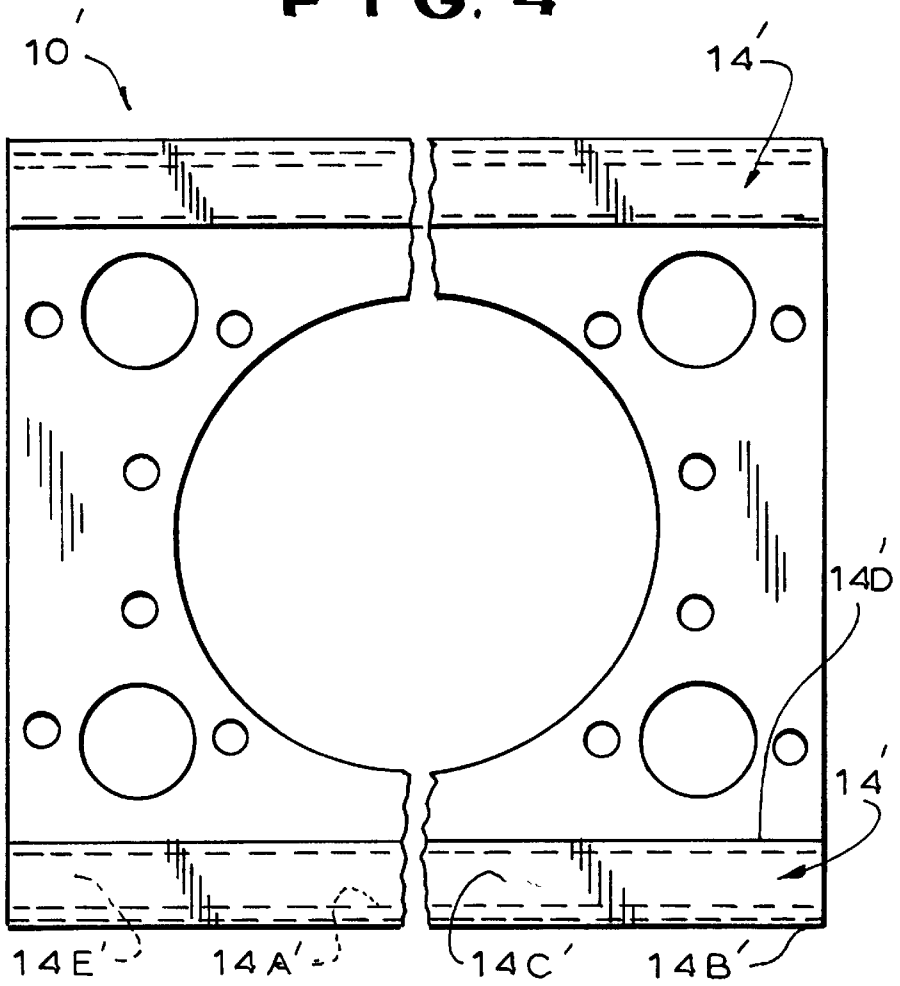
FIG. 4 is a fragmentary side elevational view of the enhancer taken along the line 4—4 of FIG. 3.
Figure 3:
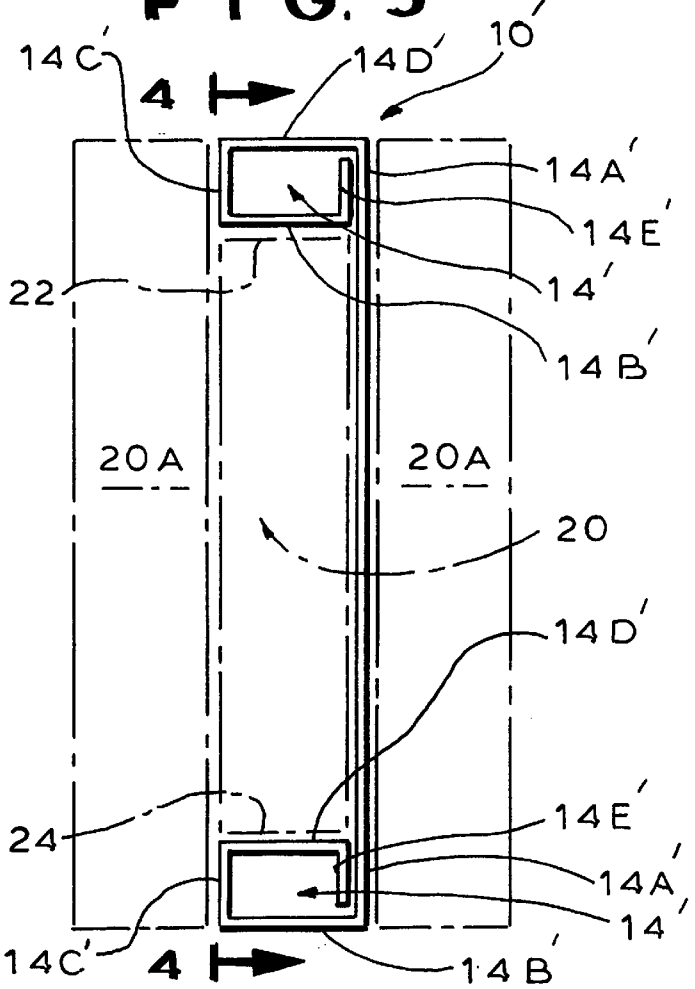
FIG. 3 is an end elevational view of a second embodiment of the enhancer and three axially extending wooden beams.

Referring now to FIGS. 3–4, therein illustrated is a second embodiment of the enhancer, generally designated 10', wherein the tubes 14' are formed of five linear segments 14A', 14B', 14C', 14D', 14E' with the first and last segments (that in the first and fifth segments 14A', 14E') in overlapping parallel relationship and preferably substantially abutting.

The addition of the fifth segment 14E' ensures that both opposed sides 22, 24 of the wooden beam 20 are in full contact with the structural metal tubes 14' of the enhancer 10', thereby ensuring a desirable composite action. By way of contrast, in the first embodiment 10 of the enhancer using the four segment tubes 14, the edges of the opposing tube segments 14A and 14D adjacent the web 12 may not be in reinforcing contact with the opposing edges of the beam 20 adjacent the web 12.

In the second embodiment 10', the overlapping first and fifth segments 14A' and 14E' add even further to the composite moment of inertia because an even greater weight of the structural metal is positioned away from the neutral axis of inertia of the beam 20 (i.e., in the tubes) than in the case of the first embodiment 10.

Figure 5:
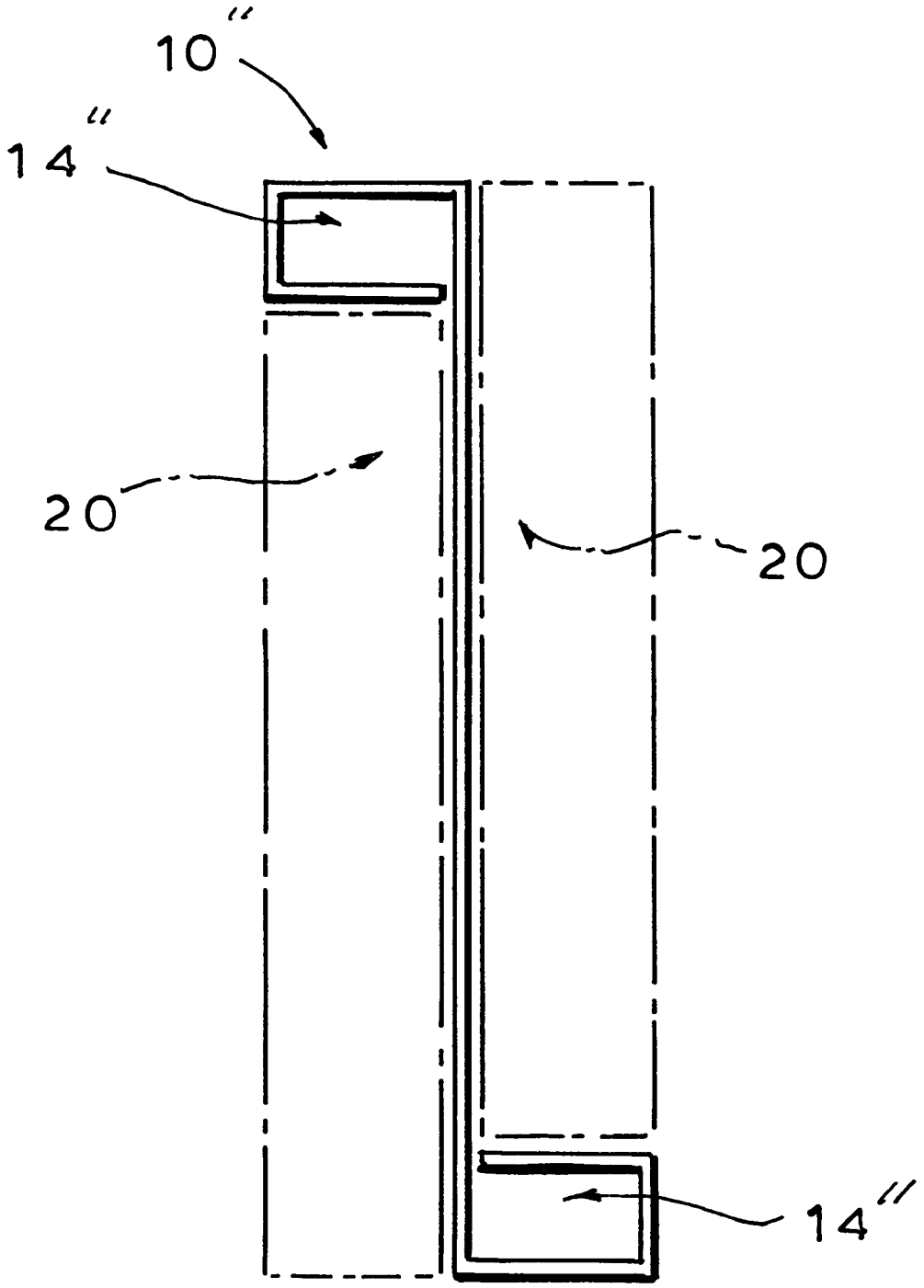
FIG. 5 is an end elevational view of a third embodiment of the enhancer and two axially extending wooden beams.

Referring now to FIG. 5, therein illustrated is a third embodiment 10" of the enhancer wherein, instead of both tubes extending to one side of the web 12, as in the first and second embodiments 10, 10', one of the tubes 14" is rotated 180° so that the two tubes 14" extend on opposite sides of the web 12. The third embodiment is used in connection with (and is secured to) at least two beams 20, one on either side of the web 12. While the third embodiment 10" is illustrated as having four segment tubes 14, as in the first embodiment 10, clearly it may alternatively have five segment tubes 14', as in the second embodiment 10'. Indeed, depending upon the particular application, one of the tubes may be of four segments and the other tube of five segments.

It will be recognized by those skilled in the art that twelve gauge metal may be too heavy to roll, as necessary to form the tubes, and in any case is very likely to be difficult to roll. Accordingly, the present invention further encompasses an enhancer in which the tubes 14, 14' are made independently of the web 12 and joined thereto by welding. The welding is preferably intermittent welding—that is, with each tube 14, 14' being welded to the web 12 for interrupted lengths along the longitudinal axis of the web—say, welded for four inch lengths separated by one inch lengths of non-welding. The intermittent welding allows adequate strength to be developed at the connection of the tubing and the web without deterioration of the metals.

A further feature of the present invention resides in a hybrid enhancer according to the present invention wherein the tubes 14, 14' welded onto the web 12 are of a different gauge than the web 12. For example, twelve gauge tubes 14, 14' may be welded on to a 16 gauge web 12. Typically the tubes are thicker (that is, of higher gauge) than the web.

EXAMPLE

In the following example, the first embodiment 10 of an enhancer according to the present invention was compared with a conventional flitch plate in terms of the moments of inertia, weight per linear foot, and allowable uniform loads (lbs./ft.) for spans ranging from 5–20 ft.

For comparison #1 the enhancer composite according to the present invention was composed of a 2×12 beam, a 2×10 beam, and an enhancer of specified gauge 12 inches in length, while the conventional flitch plate composite was composed of a ¼" thick steel flitch plate 12 inches in length sandwiched between two 2×12 beams. For comparison #2, the enhancer composite according to the present invention was composed of a 2×10, a 2×8, and an enhancer of specified gauge 10 inches in length, while the conventional composite was composed of a ¼" steel flitch plate sandwiched between two 2×10's. For comparison #3, the enhancer composite according to the present invention was composed of a 2×8, a 2×6, and an enhancer of specified gauge 8 inches in length, while the conventional flitch composite was composed of a ¼" steel flitch plate sandwiched between two 2×8's.

The inertia (I in inch$^4$), the weight per linear foot (W in lbs./lf.) and the allowable uniform load (L in lbs./ft.) were determined (for spans of 5–20 feet) for both the enhancer composites and the ¼" flitch plate composites. The results are reported in the TABLES below.

TABLE 1 presents the comparisons for an enhancer composite using a 12 gauge enhancer with either two beams or three beams. The data shows the enhancer composite with two beams has substantially the same strength as the flitch plate composite, but at a slightly lesser weight, and the enhancer composite with three beams has a substantially greater strength at about the same weight.

TABLE 2 presents the comparisons for an enhancer composite using the comparisons for a 16 gauge enhancer with either two beams or three beams. The data shows that the enhancer composite with two beams has substantially less strength than the flitch plate composite, but at a substantially lower weight, and the enhancer composite with three beams has substantially the same strength as the flitch plate composite, but at a slight saving in weight.

TABLE 3 presents the comparisons for a hybrid enhancer composite with either two beams or three beams, where the enhancer web is 16 gauge, and the enhancer tubes welded thereon are 12 gauge. The data shows that the enhancer composite with two beams has about the same strength as the flitch plate composite, but at a slightly lesser weight, while the enhancer composite with three beams has a slightly improved strength at about the same weight as the flitch plate composite.

The data of the TABLES illustrate that generally the enhancer composite is as strong or even stronger (i.e., has a higher inertia) than a comparable flitch plate composite of comparable weight and as light or even lighter (i.e., has a lower weight per linear foot).

To summarize, the present invention provides an enhancer which replaces a conventional flitch plate (whether plain art, right-angled, or C or U shaped). The enhancer composite generally affords about the same moment of inertia (or even higher) as a comparable conventional flitch plate composite, and is as light (or even lighter per linear foot) as a comparable conventional flitch plate.

The enhancers will be available at lumber yards in various sizes to fit the standard dimensional lumber, with the wall thickness of the enhancer web being available in standard gauges. The enhancer replaces flitch plates which must be bolted to and/or sandwiched between wood members and is easily modified on site without the use of a torch or special handling—for example, by cutting into size and punching out bolt or conduit holes. The present invention further provides a composite of the enhancer and at least one beam of wood.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

TABLE 1

12 GAUGE ENHANCER

| | Enhancer Composite w/2 beams | | | Flitch Plate Composite | | | Enhancer Composite w/3 beams | | |
|---|---|---|---|---|---|---|---|---|---|
| Comparison | I | W | L | I | W | L | I | W | L |
| 1 | 50.28 | 15.12 | 9534-596 | 47.5 | 17.55 | 9007-563 | 58.26 | 19.1 | 11047-690 |
| 2 | 30.00 | 13.26 | 6738-421 | 29.0 | 14.66 | 6512-407 | 34.8 | 16.72 | 7943-496 |
| 3 | 15.82 | 11.09 | 4499-281 | 12.9 | 11.62 | 3669-229 | 18.18 | 13.82 | 5283-330 |

TABLE 2

16 GAUGE ENHANCER

| | Enhancer Composite w/2 beams | | | Flitch Plate Composite | | | Enhancer Composite w/3 beams | | |
|---|---|---|---|---|---|---|---|---|---|
| Comparison | I | W | L | I | W | L | I | W | L |
| 1 | 35.87 | 12.03 | 6803-425 | 47.5 | 17.55 | 9007-563 | 43.8 | 16.01 | 8316-520 |
| 2 | 21.1 | 10.4 | 4869-304 | 29.0 | 14.66 | 6512-407 | 25.5 | 13.86 | 5982-368 |
| 3 | 10.94 | 8.51 | 3221-201 | 12.9 | 11.62 | 3669-229 | 13.1 | 11.24 | 3849-241 |

TABLE 3

16 GAUGE WEB/12 GAUGE TUBE

| | Enhancer Composite w/2 beams | | | Flitch Plate Composite | | | Enhancer Composite w/3 beams | | |
|---|---|---|---|---|---|---|---|---|---|
| Comparison | I | W | L | I | W | L | I | W | L |
| 1 | 45.3 | 13.56 | 8600-538 | 47.5 | 17.55 | 9007-563 | 53.3 | 17.54 | 10113-632 |
| 2 | 27.27 | 11.93 | 6289-393 | 29.0 | 14.66 | 6512-407 | 31.7 | 15.39 | 7312-457 |
| 3 | 14.5 | 10.04 | 4266-267 | 12.9 | 11.62 | 3669-229 | 16.63 | 12.77 | 4895-306 |

I claim:

1. In combination:

(A) at least one axially extending beam of wood, said beam being of substantially rectangular cross-section and having a pair of opposing sides and at least one bight connecting the opposing beam sides; and (B) a lumber structural enhancer of unitary, one-piece and integral construction comprising:

(i) an axially extending, thin, substantially planar web of structural metal; and (ii) a pair of axially extending, folded tubes of structural metal, said tubes being of substantially rectangular cross-section defining a hollow of substantial dimensions and connected to respective opposite ends of said web;

said web overlapping and abutting said beam bight for the entire axial length of said beam, and each of said tubes overlapping and abutting a respective one of said opposing beam sides.

2. The combination of claim 1 wherein said tubes are transversely aligned and extend to the same side of said web.

3. The combination of claim 1 wherein said tubes are four linear segment tubes folded from a single piece of structural metal, the first and last segments at least closely approaching each other in substantially transverse relationship.

4. The combination of claim 1 wherein said tubes are five linear segment tubes folded from a single piece of structural metal, the first and last segments overlapping and at least partially abutting each other in substantially parallel relationship.

5. The combination of claim 1 including an axially aligned pair of said enhancers.

6. The combination of claim 1 including at least two of said beams of wood, the combination of one said beam of wood and said enhancer, with said tubes overlapping said opposing beam sides, having a combined width dimension equal to the corresponding dimension of the other of said beams of wood.

7. The combination of claim 1 wherein said web and said tubes are of equal gauge.

8. The combination of claim 7 wherein said tubes are formed by folding of the material defining the web.

9. The combination of claim 7 wherein said tubes are separately formed from said web and then welded to respective opposite ends of said web.

10. The combination of claim 1 wherein said web and said tubes are of differing gauge.

11. The combination of claim 10 wherein said tubes are separately formed from said web and then welded to respective opposite ends of said web.

12. The combination of claim 1 wherein said web is generally continuous.

* * * * *